US006021527A

United States Patent [19]

Lessard

[11] Patent Number: 6,021,527

[45] Date of Patent: Feb. 8, 2000

[54] ANATOMICALLY DESIGNED SOCK

[75] Inventor: John J. Lessard, Clear Lake, Iowa

[73] Assignee: Fox River Mills, Inc., Osage, Iowa

[21] Appl. No.: 09/143,873

[22] Filed: Aug. 31, 1998

[51] Int. Cl.[7] ..... A41B 11/00

[52] U.S. Cl. ..... 2/239; 66/182; 66/186

[58] Field of Search ..... 2/239, 240; 66/178 R, 66/182, 185, 186, 187, 183, 194

[56] References Cited

U.S. PATENT DOCUMENTS

| | | | |
|---|---|---|---|
| 2,102,368 | 12/1937 | Martel | 66/182 |
| 2,664,726 | 1/1954 | Lihn | 66/185 |
| 4,057,981 | 11/1977 | Runac | 66/185 |
| 4,194,249 | 3/1980 | Thorneburg . | |
| 4,277,959 | 7/1981 | Thorneburg | 66/182 |
| 4,373,361 | 2/1983 | Thorneburg . | |
| 4,865,205 | 9/1989 | Thorneburg et al. . | |
| 5,103,656 | 4/1992 | Hanson, II . | |
| 5,307,522 | 5/1994 | Thorneburg et al. | 2/239 |
| 5,603,232 | 2/1997 | Thorneburg | 66/185 |
| 5,829,057 | 11/1998 | Gunn | 2/239 |

FOREIGN PATENT DOCUMENTS

WO 9709890 3/1997 WIPO .

*Primary Examiner*—Diana Oleksa
*Assistant Examiner*—Katherine Moran
*Attorney, Agent, or Firm*—Zarley, McKee, Thomte, Voorhees & Sease

[57] ABSTRACT

A sock knit throughout of at least one body yarn including an integrally knit leg portion and a foot portion. Additional yarn is knit in plated relationship with the body yarn in the ball portion of the foot, providing a thickened fabric area. This thickened fabric area is anatomically shaped to fit the ball of one of either a right or a left foot. The invention may also include additional thickened fabric areas at the heel, arch and toe portions of the sock, which are also anatomically shaped to fit the foot. A method is also provided for minimizing foot discomfort by selecting from among a plurality of socks, each pair of socks having thickened fabric areas of different volume or thickness, the sock with a volume that matches the width of the wearer's foot.

14 Claims, 1 Drawing Sheet

ANATOMICALLY DESIGNED SOCK

BACKGROUND OF THE INVENTION

1. Field of the Invention

The present invention relates generally to hosiery. More particularly, though not exclusively, the present invention relates to an improved sock construction having thickened fabric areas anatomically shaped to fit and cushion high impact areas of the foot.

2. Problems in the Art

Sock construction is well known in the art. A sock is generally constructed from a unitary design. That is, the same sock may be worn on either a right or left foot. A person's foot is not symmetrical, however. One sock cannot be anatomically fit to both a right and left foot. For this reason, a single design does not provide maximum comfort and support.

Providing thickened fabric areas in a sock is also generally known in the art. For example, U.S. Pat. No. 4,373,361 discloses the use of a thickened fabric area in the front portion of the leg of the sock to protect the leg of a skier against abrasion by a ski boot. However, thickened fabric areas have not been shaped or positioned to anatomically fit the high impact areas of a particular foot, such as the heel, ball, and toe. Because the padding in prior art socks does not vary across the high and low impact areas of the foot, it is difficult for the shoe to conform to the foot. It would therefore be desirable to provide an improved sock that provides cushion and support to different areas of the foot, particularly high-impact areas, and one that is anatomically designed for one of either a right or left foot.

After rigorous wear in hot and humid conditions, it is common for the wearer to develop blisters. Blisters are often caused by slippage inside the shoe at high impact areas of the foot. It is therefore desired to provide an improved sock that reduces slippage between the foot and the sock in high impact areas.

Today, most shoes are available in only one width. Of course, feet come in multiple widths. The volume of a sock can help to compensate for an otherwise lack of good fit. Unfortunately, socks are generally only available in one thickness or volume. Thus, it is also desired to provide a method of selecting a particular volume sock to match the width of the wearer's foot.

FEATURES OF THE INVENTION

A general feature of the present invention is the provision of an improved sock which overcomes the problems found in the prior art.

A further feature of the present invention is the provision of a sock which is anatomically shaped to fit one of either a right or left foot.

A further feature of the present invention is the provision of an improved sock that provides anatomically shaped thickened fabric areas at the high impact areas of the right and left feet, thereby minimizing foot discomfort, blisters, and other problems.

A further feature of the present invention is the provision of an improved sock that reduces the amount of slippage between the sock and the foot, thereby minimizing or eliminating blisters.

A further feature of the present invention is the provision of a method of minimizing foot discomfort by providing a sock having a volume or thickness best suited for a particular width foot.

A further feature of the present invention is the provision of a sock that is economical to manufacturer and durable in use.

These as well as other features, objects, and advantages of the present invention will become apparent from the following specification and claims.

SUMMARY OF THE INVENTION

The sock of the present invention is knit throughout of at least one body yarn and includes an integrally knit leg portion and a foot portion. Additional yard is knit in plated relationship with the body yarn in the ball portion of the foot, providing a thickened fabric area. This thickened fabric area is anatomically shaped to fit the ball of one of either a right or left foot.

The present invention may optionally include additional thickened fabric areas at the heel, arch and toe portions of the sock, which are also anatomically shaped to fit the foot. It is preferred that the thickened fabric areas in the heel portion and the ball portion of the sock have greater thickness than the thickened fabric area at the arch portion. By reducing padding in the sock where the impact is minimal and increasing padding at high impact areas, the wearer's shoe is more easily allowed to conform to the foot.

It is preferred that the additional yarn in the thickened fabric areas be made of polytetraflouroethylene fiber (such as TEFLON®) It has been found that the use of polytetraflouroethylene in socks reduces slippage inside the shoe, which reduces or eliminates blisters.

The present invention also includes a method of minimizing foot discomfort by selecting from among a plurality of socks, each pair of socks having thickened fabric areas of different volume or thickness, the sock with a volume that matches the width of the wearer's foot.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
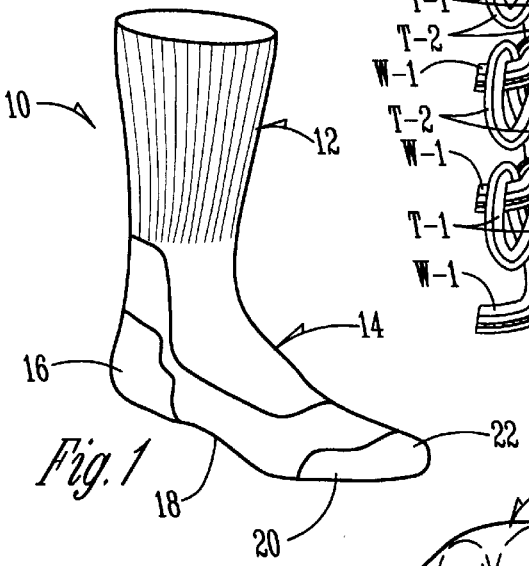
FIG. 1 is perspective view of the sock of the present invention, as it appears when positioned on the right foot of the wearer.

Referring now to FIG. 1, the sock 10 of the present invention includes a leg portion 12 that is integrally knit with a foot portion 14. The sock illustrated is of the type generally referred to as a ski sock or of the type having a reciprocated heel pocket knit therein. However, it is to be understood that the thickened fabric areas and other aspects of the invention may be incorporated in a "tube" or heelless sock.

The foot portion 14 of the sock 10 includes a heel portion 16, an arch portion 18, a ball portion 20, and a toe portion 22. As is well known in the prior art, the leg portion 12 and foot portion 14 of the sock 10 are knit throughout of at least one body yarn, illustrated as including a main body yarn B knit in plated relationship with an auxiliary body yarn Y. The main body yarn B is preferably hydrophobic yarn, such as nylon, which is moisture-repelling. The auxiliary body yarn Y is preferably a hydrophilic yarn, such as a blend of wool and silk, which draws perspiration away from the foot. The auxiliary body yarn Y is knit in plated relationship with the main body yarn B so that the auxiliary body yarn Y is positioned primarily on the outer surface of the sock while the main body yarn B is positioned primarily on the inner surface of the sock 10.

Figure 2:
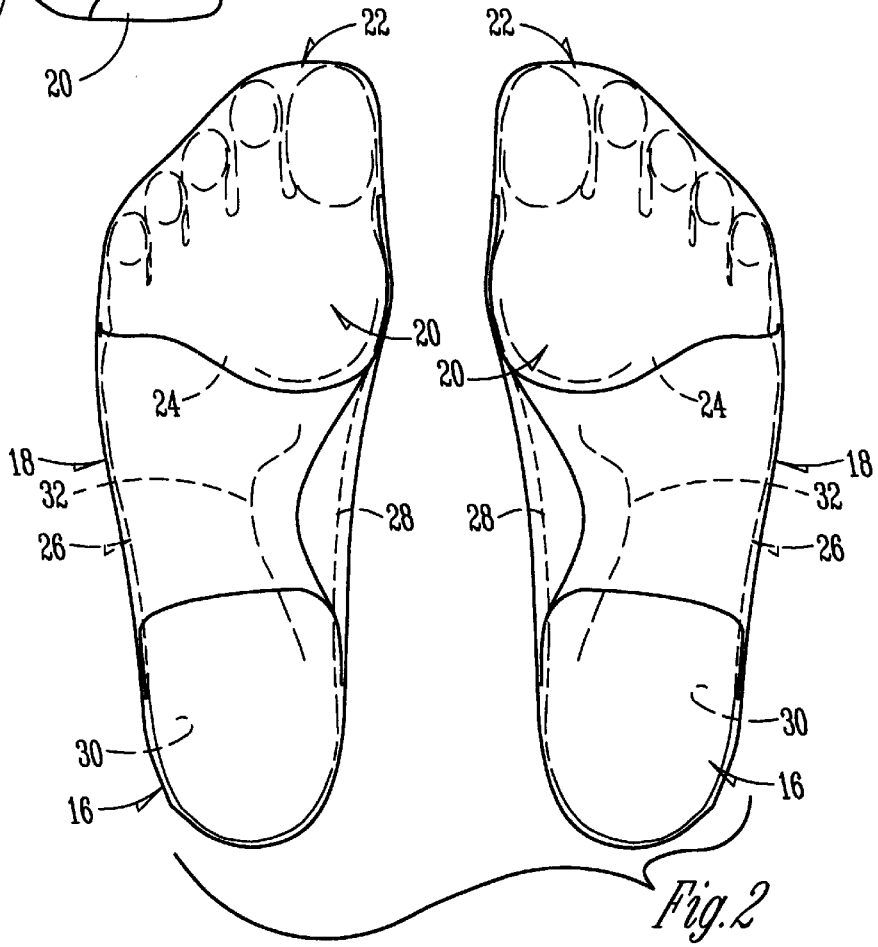
FIG. 2 is a bottom elevational view of a right and left sock of the present invention with the wearer's foot shown in dashed lines.

As illustrated in FIGS. 1 and 2, an additional yarn may be knit in a plated relationship with the body yarns to produce thickened fabric areas at the heel portion 16, arch portion 18, ball portion 20, and toe portion 22 of the sock 10. As best shown in FIG. 2, these thickened fabric areas are anatomically shaped to fit the heel, arch, ball, and toe of one of either a right or left foot. Accordingly, the construction of the sock is asymmetrical. For example, at the ball portion 20 of the sock 10 on the right foot, the outer periphery of the thickened fabric area 24 moves gradually rearward from the outside of the foot 26 to the instep. Similarly, at the heel portion of the sock, the outer periphery of the thickened fabric area 30 on the right foot moves gradually forward from the outside of the foot 26 to the instep 28. It is in this way that the thickened fabric areas (24 and 30) at the ball portion 20 and heel portion 16 of the sock 10 are anatomically shaped to fit the ball and heel of the wearer's foot. Similarly, the thickened fabric area 32 at the arch portion of the sock is anatomically shaped such that it is tapered in at the instep 26.

The sock 10 is preferably formed on a well-known circular hosiery knitting machine having a circle of needles and a knitting track, and an appropriate mechanism for lifting and/or dropping selected needles in and/or out of the knitting track during operation. One such machine is available from Sangiacomo and is identified by Model Number LT. Of course, other types of circular hosiery knitting machines can be used as well to accomplish the objects and features of the invention.

Figure 3:
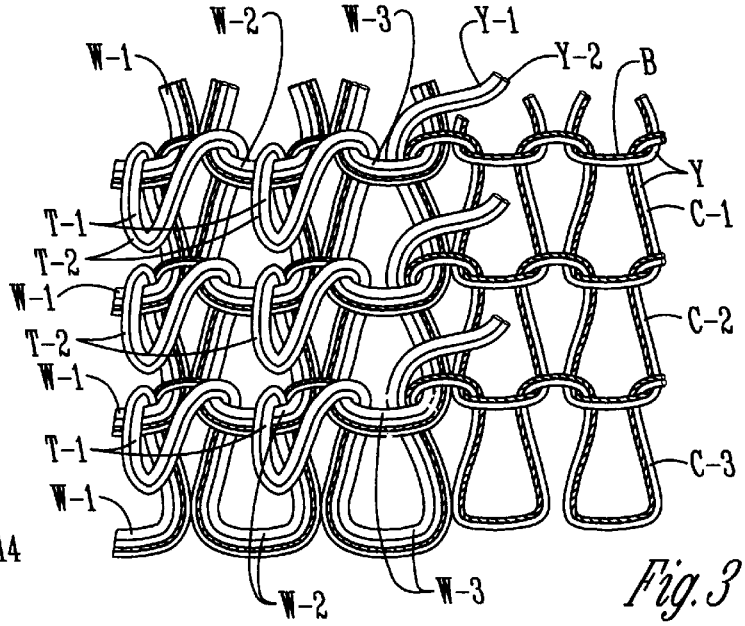
FIG. 3 is a greatly enlarged elevational view of a small area of the fabric, being taken substantially in the heel portion of the inside of the sock.

As described below, the additional yarn forms one or two sets of terry loops in certain thickened fabric areas and forms plain stitch fabric in other thickened fabric areas. As illustrated in FIG. 3, additional yarns Y-1 and Y-2 are knit in plated relationship with the body yarns Y, B in needle wales W-1, W-2, and W-3 of courses C-1, C-2, C-3 and form a thickened fabric area. The yarns Y-1 and Y-2 form respective first and second sets of terry loops T-1 and T-2 in the sinker wales of the thickened fabric area in the heel portion 16 of the sock 10. The additional yarn Y-1 is preferably a hydrophobic yarn, such as nylon, and the yarn Y-2 2 is a hydrophilic yarn, such as a blend of wool and silk.

The sets of terry loops T-1 and T-2 are formed by feeding the additional yarns Y-1 and Y-2 above the nibs of terry sinkers and from chopping yarn fingers so that these yarns are fed to and removed and cut at opposite side edges of the thickened fabric area 30. It is important to note that the thickened fabric area 30 extends inside the sock 10, such that the outer surface of the sock maintains a uniform surface. The cut ends of the additional yarns Y-1 and Y-2 extend inside of the sock and at opposite side edges of the thickened fabric area 30. The additional yarn may similarly be knit in the arch portion 18, the ball portion 20 and the toe portion 22 of the sock.

It is preferred that the thickened fabric areas in the heel, ball and toe portions of the sock have greater thickness than the thickened fabric area at the arch portion. It has been found that by reducing padding in the sock where the impact is minimal and increasing padding at high impact areas, the wearer's shoe is more easily allowed to conform to the foot. This aspect of varying the padding across the high and low impact areas of the foot is an important aspect of the invention.

An additional yarn of polytetraflouroethylene® fiber may also be knit in plated relationship with the body yarns Y and B, as illustrated in FIG. 3 and described above. It has been found that providing an additional yarn of polytetraflouroethylene (such as TEFLON®) in the heel, ball and toe portions (16, 20, 22) of the sock 10 significantly reduces slippage and friction between the sock and the skin. This helps to eliminate blisters and other skin irritations. TEFLON® brand fiber is a patented product (U.S. Pat. No. 5,590,420) available from DuPont and gives the sock an elastic quality and produces a formed fit to the foot of the wearer.

The leg portion 12 of the sock 10 is made from a true rib construction. Additional yarn of elastic or spandex (such as Lycra®) may also be plated with the body yarn throughout the leg portion 12 to provide a stay-up fit. Elastic or Spandex® may also be plated with the body yarn throughout the foot portion 14 of the sock 10 to produce a form fit.

The sock 10 of the present invention may also be made of variable volumes. That is, the thickened fabric areas may be of greater or lesser volume depending upon the width of the wearer's foot. It is in this way that one can select from a variety of different volumes of socks to tailor a sock to the width of the wearer's foot. For example, a high volume sock would be most well-suited for a narrow foot, while a low volume sock would work best for a wide foot. This maximizes comfort, minimizes friction and promotes healthier feet. The volume of a sock may be increased by plating additional yarn with the body yarn and/or by including more sets of terry loops.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalence are contemplated as circumstances may suggest or render expedient without departing from the spirit and scope of the invention as further defined in the following claims.

What is claimed is:

1. In a sock being knit throughout of at least one body yarn and including an integrally knit leg portion and foot portion, the foot portion comprising a heel portion, an arch portion, a ball portion and a toe portion, the improvement comprising:

additional yarn knit in plated relationship with the body yarn in the ball portion and toe portion and providing a first thickened fabric area having a first portion anatomically shaped to cover the toe portion and a second rounded portion which extends down from the first portion and which is anatomically shaped to cover the ball of only one of either a right or left foot.

2. The sock of claim 1 wherein said additional yarn forms terry loops in said first thickened fabric area.

3. The sock of claim 2 further comprising a second additional yarn forming a second set of terry loops in the first thickened fabric area.

4. The sock of claim 1 wherein the additional yarn is knit in plated relationship with the body yarn in the heel portion providing a second thickened fabric area anatomically shaped to fit the heel of only one of either a right or left foot.

5. The sock of claim 4 wherein the additional yarn is knit in plated relationship with the body yarn in the arch portion providing a third thickened fabric area anatomically shaped to fit the arch of only one of either a right or left foot.

6. The sock of claim 5 wherein the first and second fabric areas have greater thickness than the third fabric area.

7. A sock comprising:

an integral leg portion and foot portion knit throughout of at least one body yarn, the foot portion including a heel portion, an arch portion, a ball portion and a toe portion;

additional yarn knit in plated relationship with the body yarn in the ball portion and providing a first thickened fabric area having a rounded portion anatomically shaped to cover the ball of only one of either a right or left foot.

8. The sock of claim 7 wherein said additional yarn is made from polytetraflouroethylene® fiber.

9. The sock of claim 7 wherein the additional yarn is knit in plated relationship with the body yarn in the heel portion and providing a second thickened fabric area anatomically shaped to fit the heel of only one of either a right or left foot.

10. The sock of claim 8 wherein the additional yarn is knit in plated relationship with the body yarn in the arch portion and providing a third thickened fabric area anatomically shaped to fit the arch of only one of either a right or left foot.

11. The sock of claim 9 wherein said additional yarn is made from polytetraflouroethylene® fiber.

12. The sock of claim 9 wherein the additional yarn is knit in plated relationship with the body yarn in the toe portion and providing a fourth thickened fabric area anatomically shaped to cover the toe portion.

13. The sock of claim 12 wherein said additional yarn is made from polytetraflouroethylene® fiber.

14. A method of minimizing foot discomfort using a sock having an integral leg portion and foot portion knit throughout of at least one body yarn, the foot portion including a heel portion, an arch portion, a ball portion and a toe portion, additional yarn knit in plated relationship with the body yarn in the ball portion, toe portion and heel portion and providing thickened fabric areas anatomically shaped to fit the ball and heel of only one of either a right or left foot wherein the thickened fabric area of the ball and toe portions includes a first portion anatomically shaped to cover the toe portion and a second rounded portion which extends down from the first portion and which is anatomically shaped to cover the ball of only one of either a right or left foot, the method comprising:

selecting from among a plurality of socks, each pair of socks having thickened fabric areas of different volume to conform to different width feet, the sock correlating with the width of the foot.

* * * * *